US005419399A

United States Patent [19]

Smith

[11] Patent Number: 5,419,399

[45] Date of Patent: May 30, 1995

[54] HYDRAULIC DISCONNECT

[75] Inventor: Donald A. Smith, Innisfail, Canada

[73] Assignee: Canadian Fracmaster Ltd., Canada

[21] Appl. No.: 267,779

[22] Filed: Jun. 28, 1994

[30] Foreign Application Priority Data

May 5, 1994 [CA] Canada ..... 2122958

[51] Int. Cl.[6] ..... E21B 23/00

[52] U.S. Cl. ..... 166/377

[58] Field of Search ..... 166/377–387, 166/123, 125

[56] References Cited

U.S. PATENT DOCUMENTS

| | | | |
|---|---|---|---|
| 4,760,884 | 8/1988 | Haugen et al. | 166/377 |
| 5,133,412 | 7/1992 | Coronado | 166/381 |
| 5,201,814 | 4/1993 | Kitchell et al. | 166/377 X |
| 5,215,151 | 6/1993 | Smith et al. . | |
| 5,219,027 | 6/1993 | Taylor | 166/377 |

*Primary Examiner*—Michael Powell Buiz
*Attorney, Agent, or Firm*—Lerner, David, Littenberg, Krumholz & Mentlik

[57] ABSTRACT

There is described an improved method and apparatus for releasably connecting one part of a tool string to another, comprising a tubular housing having an uphole and a downhole end, a piston slidably disposed within the tubular housing for longitudinal movement therein between a first position and a second downstream position, the piston having a sealable bore formed therethrough for passage of a pressurized fluid, first connectors for releasably maintaining the piston in the first position thereof prior to sealing of the bore in the piston, a tubular bottom sub having an uphole end for concentric connection to the downhole end of the tubular housing, and a downhole end adapted for connection to a tool string and second connectors for releasably connecting the tubular housing to the bottom sub to normally prevent axial separation therebetween, wherein the piston, upon sealing of the bore to block the passage of pressurized fluid therethrough and in response to the pressure of the fluid then acting on the piston, is movable from its first to its second position to allow release of the second connectors, whereupon the tubular housing and the bottom sub become separable.

27 Claims, 2 Drawing Sheets

HYDRAULIC DISCONNECT

FIELD OF THE INVENTION

There is described an hydraulic disconnect and more particularly a disconnect and a method for using the same that permits the downhole separation of coiled tubing from a tool string used in the drilling and servicing of oil and gas wells.

BACKGROUND OF THE INVENTION

Increasingly, the drilling of oil and gas wells is no longer a matter of drilling a vertically straight bore hole from the surface to the zone of hydrocarbon recovery using a traditional drilling platform surmounted by a derrick used to support a string of jointed drill pipe having a bit at the lower end thereof. Rather, technology and techniques have been developed to deviate the bore's trajectory at angles of up to and sometimes exceeding 90° from the vertical. Directional drilling offers numerous advantages including new approaches to oil and gas traps having non-conventional geometries, economic zone enhancement as can occur for example if the bore hole actually follows an oil or gas bearing strata, improved economics particularly in an overpressured environment (when formation pressure is sufficient to force hydrocarbons to the surface at potentially explosive rates) and reduced environmental degradation.

After deviating a bore hole from the vertical, it's obviously no longer completely practical to sustain continuous drilling operations by rotating the drill string in order to rotate the bit. Preferably, only the bit, but not the string, is rotated by a downhole motor attached to the lower end of the string, the motor typically consisting of a rotor-stator to generate torque as drilling fluid passes therethrough, a bent housing to deviate the hole by the required amount and which also encloses a drive shaft therethrough to transmit the rotor/stator's torque to a bearing assembly, and a bit rotatably supported at the downhole end of the bearing assembly for cutting the bore hole.

Electronic means supported by a mule shoe in the bottom hole assembly and connected to the surface by a wire line passing through the interior of the drill string transmits information with respect to the degree and azimuth of the bore hole's trajectory so that it can be plotted and necessary adjustments made. Once the required direction of the hole's trajectory has been attained, the motor must be withdrawn from the well, the bent housing either removed or straightened (if it's of the adjustable sort) and the motor is then run back into the hole to resume drilling operations. Each time the motor requires service, or a change in the hole's trajectory is required, this process must be repeated. This results in substantial costs and down time largely due to the time required to make and break all of the joints as the drill string is tripped in and out of the hole.

SUMMARY OF THE INVENTION

To overcome this problem, discrete lengths of jointed drill pipe are being replaced where feasible with coiled tubing which is a single length of continuous, unjointed tubing spooled onto a reel for storage in sufficient quantity to exceed the maximum length of the bore hole being drilled. The injection and withdrawal of the tubing can be accomplished more rapidly in comparison with conventional drill pipe due in large part to the elimination of joints. However, as with conventional pipe, drilling mud and wire lines for downhole instrumentation pass through the tubing's interior.

Coiled tubing has been extensively used for well servicing as well as for workovers within previously drilled holes.

More recently, tools and methods have been developed for the actual drilling of bore holes using coiled tubing and reference is made in this regard to U.S. Pat. No. 5,215,151 describing one such system. Generally speaking however, the tools so far developed for connecting and disconnecting the coiled tubing, which is not threaded, to the downhole motor and tool strings suffer from numerous disadvantages, including poor resistance to rotation, inadequate strength, poor serviceability and general unreliability.

Moreover, a more reliable means of separating the coiled tubing from the tool string (also called the bottom hole assembly) is required in the event the tool string becomes sanded in or stuck in some other way. Should this happen, it's important to ensure that the tubing can be reliably disconnected from the tool string at a predetermined point, leaving a fishing neck for retrieval of the remaining assembly stuck in the hole.

Accordingly, it is an object of the present invention to provide an improved hydraulic disconnect for releasably coupling the tubing string to the tool string downhole thereof and which obviates and mitigates from the disadvantages of the prior art.

It is a further object of preferred embodiments of the present invention to provide an improved hydraulic disconnect that is adapted to accommodate a wire line or capillary tube for downhole instrumentation, that can maintain pressure control during a downhole release and which also includes means that can be alternately locked and unlocked to permit rotation of at least a part of the disconnect's housing for purposes of normal coupling to the tool string.

According to the present invention then, there is provided apparatus for releasably connecting one part of a tool string to another, comprising a tubular housing having an uphole and a downhole end, piston means slidably disposed within said tubular housing for longitudinal movement therein between a first position and a second downstream position, said piston means having a sealable bore formed therethrough for passage of a pressurized fluid, first connecting means for releasably maintaining said piston means in said first position thereof prior to sealing of said bore, a tubular bottom sub having an uphole end for concentric connection to said downhole end of said tubular housing and a downhole end adapted for connection to a tool string, and second connecting means for releasably connecting said tubular housing to said bottom sub to normally prevent axial separation therebetween, wherein said piston means, upon sealing of said bore to block the passage of pressurized fluid therethrough and in response to the pressure of said fluid on said piston means, are movable from said first to said second position thereof allowing release of said second connecting means, whereupon said tubular housing and said bottom sub become separable.

According to present invention then, there is also provided a method for disconnecting one part of a tool string in a bore hole from another, comprising the steps of establishing a path for the flow of pressurized fluid from the top of the bore hole to the tool string, providing at least one shearable member connecting first and second contiguous parts of said tool string, providing a sealable member in said flow path, causing a sealing member to travel through said flow path to engage said sealable member to block the flow of said fluid therethrough, and transmitting the force of said pressurized fluid acting on said sealable member after sealing thereof to said shearable member to rupture the same, whereby said first and second contiguous portions of said tool string become separable.

BRIEF DESCRIPTION OF THE DRAWINGS

Preferred embodiments of the present invention will now be described in greater detail and will be better understood when read in conjunction with the following drawings in which.

DETAILED DESCRIPTION

Figure 1:
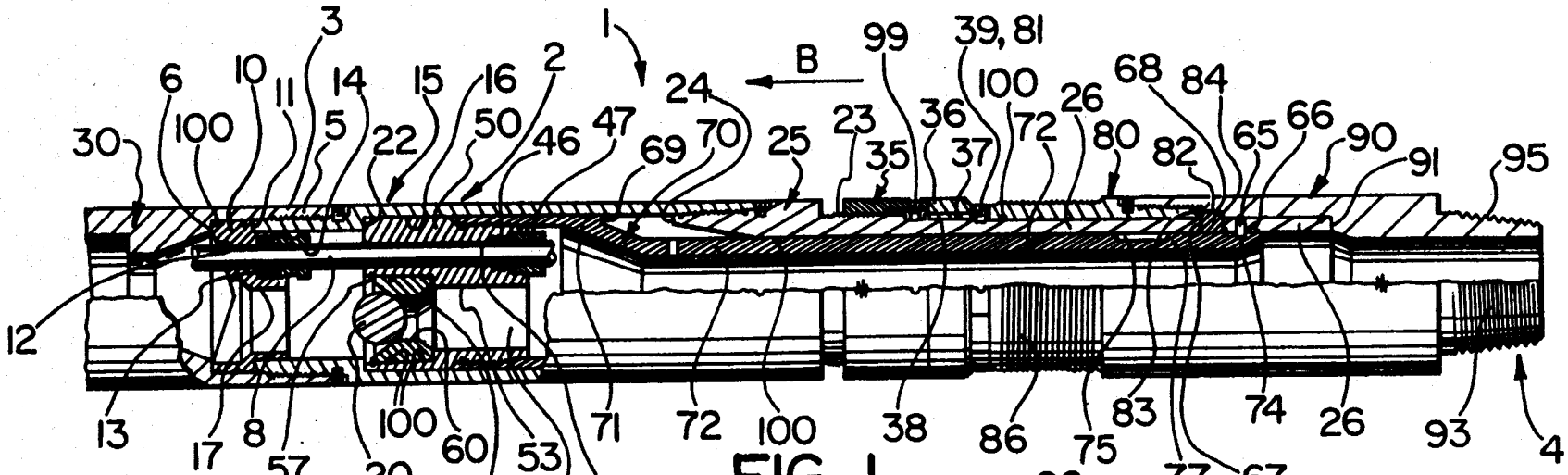
FIG. 1 is a side elevational, cross-sectional view of the hydraulic disconnect described herein in a locked position thereof.

With reference to the drawings, hydraulic disconnect 1 as will now be described herein generally comprises from its uphole to its downhole ends 3 and 4 respectively, a tubular housing 2 comprising a tubular piston housing 15 threadedly connected to a tubular key retainer 25. The downhole end 26 of retainer 25 fits slidably into a bottom sub assembly consisting of a cap 80 and a tubular bottom sub 90. End 3 of housing 15 is itself adapted for threaded connection to the downhole end 5 of a cylindrical seal sub 30 that forms part of a coiled tubing connector used to connect the terminal end of the tubing string (not shown) to the top of the downhole tool assembly of which the present disconnect is a part.

A typical approach to a safety downhole disconnect in the event the tool string becomes stuck is to provide shear screws that couple the tubing string to the tool string. These screws are sheared off by pulling back on the tubing string with sufficient force to cause shearing. The shear strength of the tubing must therefore exceed that of the shear screws. This approach is described in the aforementioned '151 patent with particular reference to FIG. 9 and shear screws 260 shown therein and the description thereof at column 9, line 27. The shear strength of coiled tubing is unpredictable however due to, inter alia, phenomena such as cycle fatigue induced in the tubing during spooling and unspooling operations from the storage reel and particularly as the tubing passes back and forth over the guide arch used to direct the tubing into the tubing injector. This fatigue occurs randomly and results in zones of reduced tensile strength. It's therefore entirely possible and even predictable that the tubing will rupture at one of these zones of weakness prior to shearing of the shear screws, in which event retrieval of the remaining tubing and the tool assembly below the rupture is made considerably more difficult and expensive.

Advantageously therefore a more reliable means of ensuring that the tubing and tool string are uncoupled at a predetermined point is to be preferred wherein it is unnecessary to pull on the tubing string in order to cause shearing of the shear screws. In this regard, further reference will now be made to the present disconnect mechanism which uses the pressure of the hydraulic drilling fluid to induce shearing.

Figure 3:
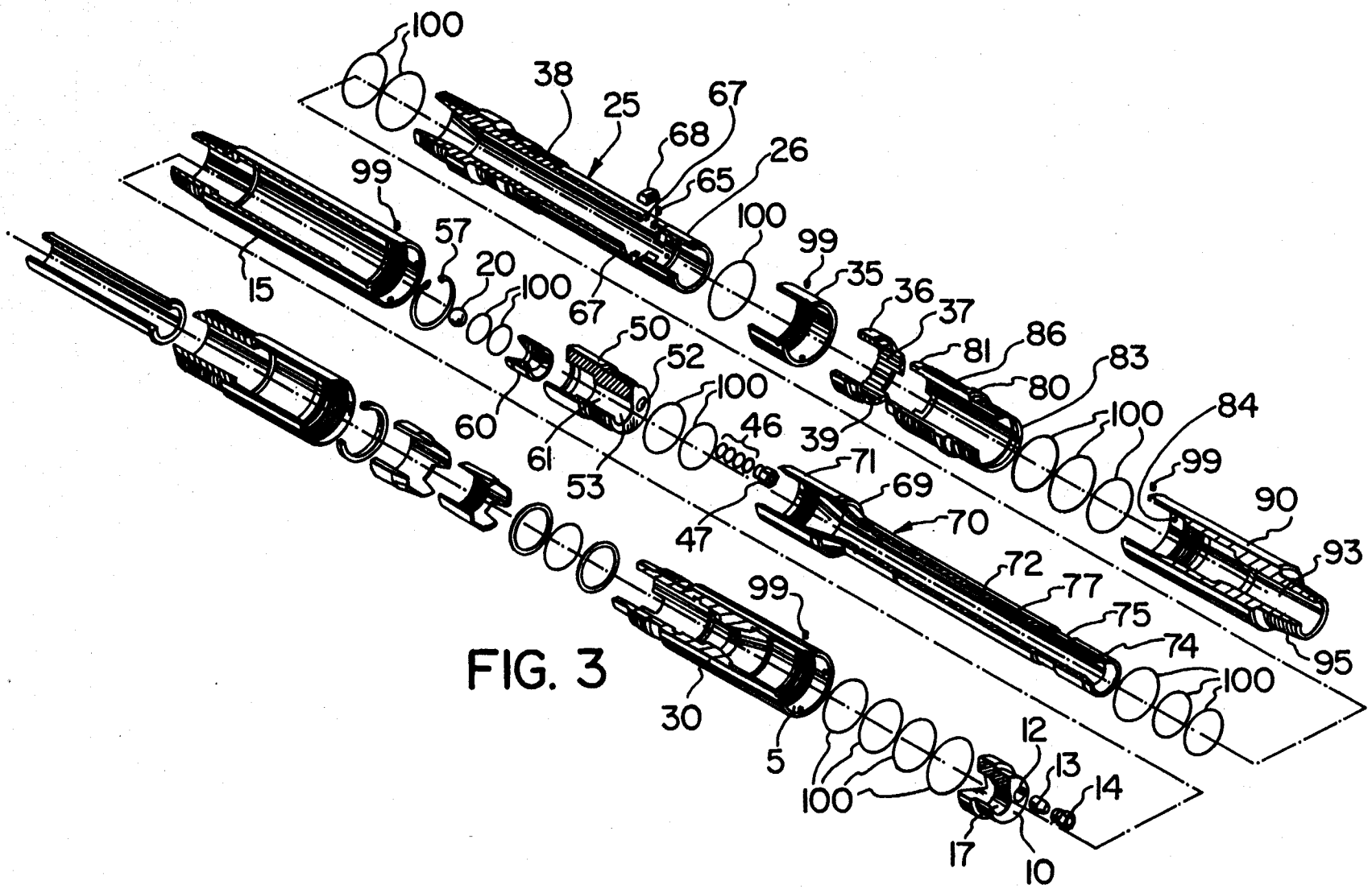
FIG. 3 is an exploded isometric, partially sectional view of the hydraulic disconnect of FIG. 1.

With reference once again to FIGS. 1 and 3, open end 3 of housing 15 is fitted with a metallic cylindrical anchor plate 10 having a shoulder 11 that abuts against end 3 of housing 15 to limit the anchor plate's insertion. With seal sub 30 assembled to housing 15, anchor plate 10 is compressed between a shoulder 6 in the seal sub and end 3 of housing 15. The anchor plate includes two off-centre axially aligned apertures, the first of which, 12, is for a wire line or capillary tube 8 and the second of which, 17, is smooth-bored and larger in diameter for passage of a steel ball 20 the purpose of which will be described below. Capillary tube 8 is immovably connected to the anchor plate by buttress-threaded slips 13 and jamb nut 14.

Downstream of anchor plate 10, bore 16 of housing 15 widens at shoulder 22 to concentrically and slidably receive therein a piston top sub 50. Sub 50 also includes two off-centre bores or apertures 52 and 53 formed therethrough to be in axial alignment with apertures 12 and 17 in anchor plate 10, respectively. Wire line 8 passes slidably through aperture 52 and is sealed against fluid leakage by packing 46 and jamb nut 47. The upstream end of aperture 53 supports a replaceable frustoconical ball seat 60 held in place against shoulder 54 by a snap ring 57. The combination of ball seat 60 and the downstream end of aperture 53 define a funnel mouthed flow channel 61 through piston top sub 50, the channel having an inner diameter smaller than that of ball 20 so that the ball closes channel 61 against fluid flow when required for disconnection as will be described in greater detail below.

As will be appreciated, if no wire line or capillary tube is to be used in a particular situation, apertures 12 and 52 can be eliminated (or plugged) from anchor plate 10 and piston top sub 50, respectively. In fact, in such a situation, anchor plate 10 itself can be removed completely if desired. Otherwise, it can remain in place but will serve no particular function. Similarly, aperture 52 in the piston top can be fitted with a one-way check or ball valve instead of simply being plugged.

Piston top sub 50 is threadedly connected to a piston bottom sub 70 including an upper body 71 that narrows in the downstream direction to form a mandrel 72. Mandrel 72 fits closely but slidably through the bore of key retainer 25 and it and the piston top sub are fixedly held in the position shown in FIG. 1 relative to piston housing 15 and key retainer 25 by means of shear screws 65. Screws 65 pass through threaded apertures 66 in the downstream end 26 of the key retainer into an aligned annular groove 74 in the downstream end 77 of mandrel 72. In one embodiment constructed by the applicant, four shear screws 65 spaced apart at 90° intervals are used to make this connection.

Proceeding downstream, a tubular cap 80 and a threadedly connected bottom sub 90 are slidably installed over the downhole end 26 of key retainer 25 until contact is made between end 26 and an internal shoulder 91 on bottom sub 90. The bottom sub 90/cap 80 combination and key retainer 25 are locked together to prevent axial separation by means of chamfered pins or keys 68 that fit through apertures 67 in end 26 of key retainer 25 and engage an aligned annular notch or groove 82 defined by the adjoining surfaces 83 and 84 of cap 80 and bottom sub 90 respectively.

To install keys 68, key retainer 25 is moved upstream to expose apertures 67, and bottom sub 90 is removed if previously assembled to cap 80. The keys are then manually inserted into the apertures. Some grease applied to the keys will help hold them in place in apertures 67 as key retainer 25 is moved back into place to align shear screws 65 with annular groove 74. Once screws 65 have been fully driven into groove 74, sub 90 can be reinstalled to complete assembly.

The downhole end 93 of bottom sub 90 includes drilling threads 95 for connection to the remainder of the tool string for make-up or disassembly. It's therefore desirable that the bottom sub be rotatable to facilitate its connection to the tool string. During drilling operations however, the bottom sub should be non-rotatably locked to the rest of the disconnect. This locking also serves to inhibit rotation of the tool assembly otherwise occurring due to the transmission of torque from the bit/rock interface.

With reference once again to FIG. 1, key retainer 25 is externally threaded at 23 for connection to a correspondingly internally threaded locking nut 35 which, by simple rotation, can be backed off in the direction of arrow B. Locking nut 35 abuts against a concentric slider 36 having radially inwardly extending splines 37 that mesh with cooperating radially outwardly extending splines 38 formed on the outer surface of key retainer 25. The splines 37 and 38 obviously prevent the slider from rotating relative to the key retainer.

A plurality of spaced apart lugs 39 are formed at the downhole end of slider 36 to mesh with correspondingly-shaped lugs 81 provided on the upstream end of cap 80. With lugs 39 and 81 meshed together, cap 80 and bottom sub 90 are non-rotatably locked to key retainer 25. By backing off locking nut 35 in the direction of arrow B so that slider 36 can also be backed off in the same direction, lugs 39 and 81 separate so that cap 80/sub 90 are then free to rotate relative to the key retainer.

Figure 2:
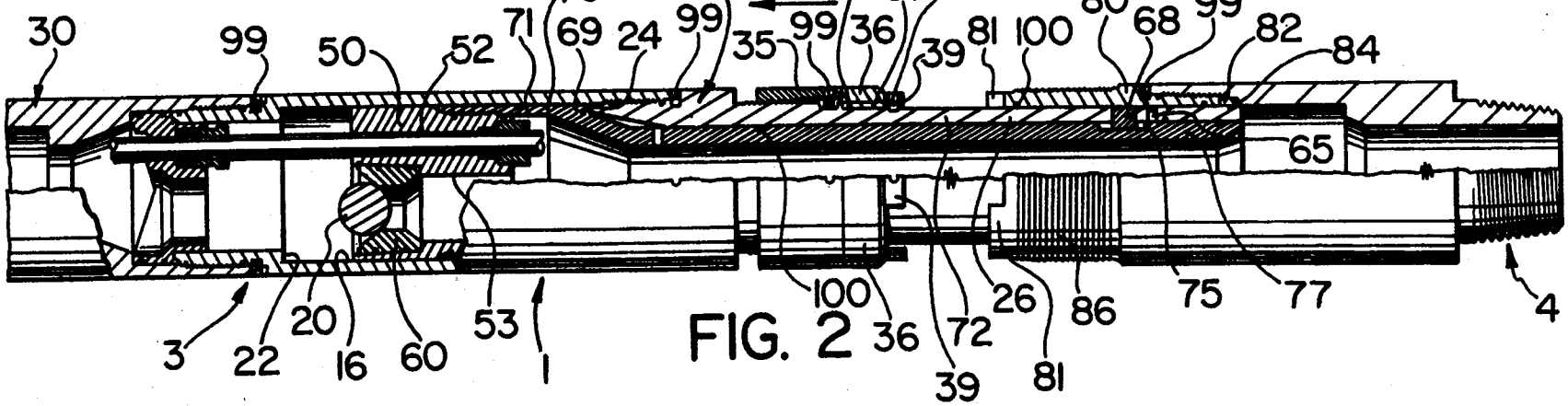
FIG. 2 is a side elevational, cross-sectional view of the disconnect of FIG. 1 in a released condition for separation from the downhole tool string.

Reference will now be made to FIG. 2. In the event the downhole tool assembly becomes stuck, disconnect 1 is activated by pumping steel ball 20 from the surface through the tubing string and aperture 17 in anchor plate 10 and then into seat 60 to close flow channel 61. With channel 61 sealed, piston top sub 50 transmits the pressure of the drilling fluid against screws 65 via mandrel 72, this pressure being sufficient to cause shearing of the screws which in turn allows mandrel 72 and the other piston assembly components attached thereto to move in the downhole direction. After shearing, the downhole travel of mandrel 72 is limited by contact between shoulder 69 on piston bottom sub 70 and the uphole end 24 of key retainer 25 so that an annular groove 75 in the mandrel aligns itself with keys 68. If the keys do not naturally drop into groove 75, then by pulling back slightly or agitating the disconnect, keys 68 will then fall or dislodge into groove 75 which is sufficiently deep that the keys completely disengage notches 82. Key retainer 25 can then be pulled clear simply by normal withdrawal of the coiled tubing from the hole. This leaves behind the buttress-threaded fishing neck 86 on cap 80 for retrieval of the tool assembly using conventional recovery techniques.

As a safety measure, set screws 99 are used to prevent the inadvertent backing off of the threaded connections between the various housings, subs, retainers and locking nuts described above.

O rings 100 are placed where required to prevent the escape of drilling fluid flowing through the disconnect into the well bore to prevent a loss of circulation at the bit.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. Apparatus for releasably connecting one part of a tool string to another, comprising:

a tubular housing having an uphole and a downhole end;

piston means slidably disposed within said tubular housing for longitudinal movement therein between a first position and a second downstream position, said piston means having a sealable bore formed therethrough for passage of a pressurized fluid;

first connecting means for releasably maintaining said piston means in said first position thereof prior to sealing of said bore;

a tubular bottom sub having an uphole end for concentric connection to said downhole end of said tubular housing and a downhole end adapted for connection to a tool string; and second connecting means for releasably connecting said tubular housing to said bottom sub to normally prevent axial separation therebetween;

wherein said piston means, upon sealing of said bore to block the passage of pressurized fluid therethrough and in response to the pressure of said fluid on said piston means, are movable from said first to said second position thereof allowing release of said second connecting means, whereupon said tubular housing and said bottom sub become separable.

2. The apparatus of claim 1 further including locking means actuatable to permit or prevent rotation of said bottom sub relative to said tubular housing.

3. The apparatus of claim 2 wherein said locking means comprise slider means non-rotatably disposed on said tubular housing for axial movement towards and away from said bottom sub, said slider means having means thereon to releasably engage cooperating means on said sub means to prevent rotation thereof relative to said slider means.

4. The apparatus of claim 3 further including nut means rotatably disposed on said tubular housing adjacent said slider means, said nut means being adjustable to alternately bias said slider means into locking engagement with said bottom sub and to release said slider means from contact with said tubular sub.

5. The apparatus of claim 4 including a splined connection between said slider means and said tubular housing.

6. The apparatus of claim 5 wherein said means on said slider means and said cooperating means on said bottom sub comprise lugs adapted for meshed engagement.

7. The apparatus of claim 6 wherein said tubular bottom sub comprises a tubular cap and a tubular sub threadedly connected to said cap to extend axially downstream thereof.

8. The apparatus of claim 7 wherein said second connecting means comprise at least one pin member disposed between said tubular housing and said bottom sub.

9. The apparatus of claim 8 wherein said at least one pin member extends through a cooperating aperture in said tubular housing and thence at least partially into said bottom sub, said bottom sub having annular grooves formed in an inner surface thereof to receive said at least one pin member thereinto, such that said pin member rotatably connects said tubular housing to said bottom sub.

10. The apparatus of claim 9 wherein said piston means, when in said first position thereof, maintains said at least one pin member in place between said tubular housing and said bottom sub.

11. The apparatus of claim 10 wherein said piston means include an annular groove formed therein to at least partially receive said at least one pin member thereinto when said piston means are in said second position thereof, whereby said tubular housing and said bottom sub become axially separable.

12. The apparatus of claim 11 wherein said first connecting means comprise at least one shearable member extending between said tubular housing and said piston means.

13. The apparatus of claim 12 wherein said at least one shearable member is rupturable in response to the pressure of a fluid acting on said piston means following sealing of said bore formed through said piston means.

14. The apparatus of claim 13 wherein said piston means comprise a piston member and an elongated mandrel member extending axially downstream thereof.

15. The apparatus of claim 14 wherein said sealable bore extends axially through said piston member, said bore being adapted for sealing by a spherical ball member.

16. The apparatus of claim 15 wherein said bore includes a ball seat at an uphole end thereof for sealing engagement with said ball member.

17. The apparatus of claim 16 wherein said piston member includes a second bore formed axially therethrough for fluid-tight but slidable connection to wire means passing therethrough.

18. The apparatus of claim 17 wherein said ball seat is removable from said piston member for intermittent replacement thereof.

19. The apparatus of claim 18 further including a plate member fixedly disposed in said tubular housing upstream of said piston member, said plate member having a first bore formed axially therethrough to be in substantial axial alignment with said bore in said piston member, the diameter of said bore in said plate member being sufficient to allow said ball member to pass freely therethrough.

20. The apparatus of claim 19 wherein said plate member includes a second bore formed axially therethrough to be in substantial axial alignment with said second bore in said piston member, said second bore in said plate member being adapted for non-sliding, fluid-tight connection to wire means passing therethrough.

21. The apparatus of claim 20 wherein said tubular housing comprises a piston housing and a retainer housing threadedly connected in axial alignment downstream thereof.

22. The apparatus of claim 21 wherein said mandrel member is slidably and concentrically disposed within said retainer housing for movement between said first and second positions of said piston means.

23. The apparatus of claim 22 wherein said annular groove in said piston means is formed in an outer surface of said mandrel member for alignment with said at least one pin member when said piston means are in said second position thereof.

24. The apparatus of claim 23 wherein said at least one shearable member extends through said retainer housing to engage a second annular groove in said outer surface of said mandrel member.

25. The apparatus of claim 24 wherein said tubular housing includes first shoulder means therein for contacting said piston member to limit the travel thereof in an uphole direction.

26. The apparatus of claim 25 wherein said tubular housing includes second shoulder means therein for contacting said mandrel member to limit the travel of said piston means in a downhole direction.

27. A method for disconnecting one part of a tool string in a bore hole from another, comprising the steps of:

establishing a path for the flow of pressurized fluid from the top of the bore hole to the tool string;

providing at least one shearable member connecting first and second contiguous parts of said tool string;

providing a sealable member in said flow path;

causing a sealing member to travel through said flow path to engage said sealable member to block the flow of said fluid therethrough; and transmitting the force of said pressurized fluid acting on said sealable member after sealing thereof to said shearable member to rupture the same, whereby said first and second contiguous portions of said tool string become separable.

* * * * *